US010833424B2

(12) United States Patent
Ghaemi et al.

(10) Patent No.: US 10,833,424 B2
(45) Date of Patent: Nov. 10, 2020

(54) RECONFIGURABLE ANTENNA SUITABLE FOR WEARABLES AND INTERNET OF THINGS (IOT) APPLICATIONS

(71) Applicant: MOTOROLA MOBILITY LLC, Chicago, IL (US)

(72) Inventors: Kasra Ghaemi, Chicago, IL (US); Eric L. Krenz, Crystal Lake, IL (US); Michael E. Russell, Lake Zurich, IL (US)

(73) Assignee: Motorola Mobility LLC, Chicago, IL (US)

( * ) Notice: Subject to any disclaimer, the term of this patent is extended or adjusted under 35 U.S.C. 154(b) by 41 days.

(21) Appl. No.: 16/289,619

(22) Filed: Feb. 28, 2019

(65) Prior Publication Data

US 2020/0280141 A1 Sep. 3, 2020

(51) Int. Cl.

| | |
|---|---|
| ***H01Q 21/28*** | (2006.01) |
| ***H01Q 1/27*** | (2006.01) |
| ***H01Q 9/42*** | (2006.01) |
| ***H01Q 9/04*** | (2006.01) |

(52) U.S. Cl.

CPC ..... *H01Q 21/28* (2013.01); *H01Q 1/273* (2013.01); *H01Q 9/0421* (2013.01); *H01Q 9/42* (2013.01)

(58) Field of Classification Search

CPC ..... H01Q 21/28; H01Q 1/273; H01Q 9/42; H01Q 9/0421

See application file for complete search history.

(56) References Cited

U.S. PATENT DOCUMENTS

| | | | | |
|---|---|---|---|---|
| 7,057,560 | B2 * | 6/2006 | Erkocevic | H01Q 1/243 343/700 MS |
| 8,629,813 | B2 * | 1/2014 | Milosavljevic | H01Q 1/243 343/850 |
| 2004/0164913 | A1 * | 8/2004 | Ogino | H01Q 1/1271 343/713 |

(Continued)

OTHER PUBLICATIONS

Dong, Gaoya, et al., "A Compact Low-profile Smartwatch Antenna for Wireless Body Local Network Application", IEEE 5th International Symposium on Electromatic Compatabifity (EMC-Beijing), Oct. 2017.

(Continued)

*Primary Examiner* — Daniel D Chang
(74) *Attorney, Agent, or Firm* — Yudell Isidore PLLC

(57) ABSTRACT

A communication device provides an elongate antenna element having a first and a second end separated by an aperture. A transceiver is electrically grounded to a ground plane and communicatively coupled via an antenna feed to the elongate antenna element. A first conductor is electrically attached to a first edge of the ground plane. An antenna switching controller selectively actuates the aperture switch to be in one of the open and closed positions based on whether the communication device is positioned on a body. The open position electrically isolates (a) the first end of the elongate antenna element; (b) the second end of the elongate antenna element; and (c) the first conductor. The closed position electrically couples: (a) the first end of the elongate antenna element; (b) the second end of the elongate antenna element; and (c) the first conductor.

18 Claims, 7 Drawing Sheets

(56) References Cited

U.S. PATENT DOCUMENTS

2010/0052933 A1* 3/2010 Gunton ..... E05F 15/43
340/686.6

OTHER PUBLICATIONS

Hong, Wonbin et al., OLED-Embedded Antennas for 2A GHz Wi-Fi and Bluetooth Applications, IEEE International Symposium on Antennas and Propagation and USNC/URSI National Radio Science Meeting, Jul. 2017.
Wu, Di et al., "Slot Antenna for All-Metal Smartwatch Applications", 10th European Conference on Antennas and Propagation, Apr. 2016.
Chen, Yen-Sheng, et al., "A Low-Profile Wearable Antenna Using a Miniature High Impedance Surface for Smartwatch Applications", IEEE Antennas and Wireless Propagation Letters, Oct. 2015.
Tong, Xuanfeng et al., Switchable On-/Off-Body Antenna for 2.45 GHz WBAN Applications, IEEE Transactions on Antennas and Propagation, vol. 66, No. 2, Feb. 2018.

* cited by examiner

Antenna Switching Controller 178

| Antenna Mode | Antenna Type | A-B-C Aperture Switch State |
|---|---|---|
| On-Body | Hollow Planar Inverted F Antenna (PIFA) | ON -- Closed |
| Free Space (FS) | Dual Inverted L Antenna (DILA) | OFF -- Open |

Antenna Switching Controller 178

| Antenna Mode | Antenna Type | A-B-C Aperture Switch State |
|---|---|---|
| On-Body | Hollow Planar Inverted F Antenna (PIFA) | ON -- Closed |
| Free Space (FS) | Dual Inverted L Antenna (DILA) | OFF -- Open |

| Antenna Mode | Antenna Type | A-B-C Aperture Switch State |
|---|---|---|
| On-Body | Hollow Planar Inverted F Antenna (PIFA) | ON -- Closed |
| Free Space (FS) | Folded (Meandering) Monopole Antenna | OFF -- Open |

| Antenna Mode | Antenna Type | A-B-C Aperture Switch State |
|---|---|---|
| On-Body | Hollow Planar Inverted F Antenna (PIFA) | ON -- Closed |
| Free Space (FS) | Folded (Meandering) Monopole Antenna | OFF -- Open |

RECONFIGURABLE ANTENNA SUITABLE FOR WEARABLES AND INTERNET OF THINGS (IOT) APPLICATIONS

BACKGROUND

1. Technical Field

The present disclosure relates generally to communication devices and in particular to selectable antennas for communication devices.

2. Description of the Related Art

Several important factors need to be taken into consideration when designing antennas that are required to operate on or proximate to a body. These factors include antenna detuning, impedance matching, radiation pattern, size, cost, weight, positioning, bending and stable performance with the variation of the gap between the antenna and the human body. A human body has a lossy dielectric property that alters antenna performance as the gap changes. An antenna addressing these challenges is suitable for on-body communication and wearable/detachable applications. Antennas used in most wearables (e.g., smart-watches, etc.) are mainly optimized for on-body performance using a planar inverted F antenna (PIFA). In on-body mode, PIFAs provide good performance in ultra-low band ULB or low band (LB) radio access networks (RANs) in the approximate frequency range of 600 to 960 MHz. However, when not worn, PIFAs perform poorly when operating in free space (FS). The antenna design relies upon the presence of the body as part of antenna performance.

Small communication devices, such as an Internet of Things (IoT) sensor or controller, are intended to be mounted to a structure in free space. Antennas of these communication devices that are intended to operate in FS mode are not designed for use in close proximity to a human body. Generally, FS antenna configurations perform poorly in on-body mode.

BRIEF DESCRIPTION OF THE DRAWINGS

The description of the illustrative embodiments can be read in conjunction with the accompanying figures. It will be appreciated that for simplicity and clarity of illustration, elements illustrated in the figures have not necessarily been drawn to scale. For example, the dimensions of some of the elements are exaggerated relative to other elements. Embodiments incorporating teachings of the present disclosure are shown and described with respect to the figures presented herein, in which.

DETAILED DESCRIPTION

Figure 1:
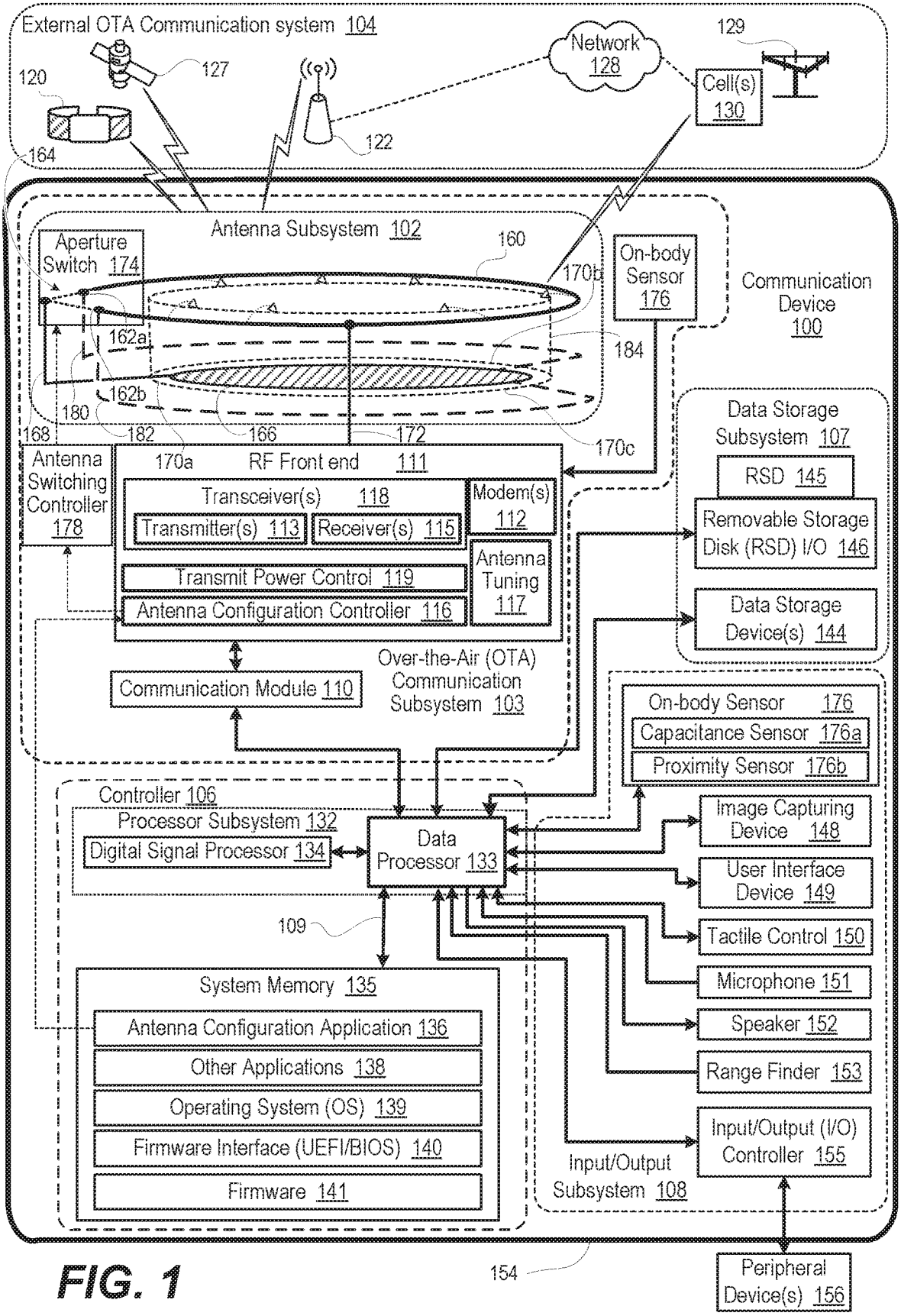
FIG. 1 is a simplified functional block diagram illustrating a communication device that includes an antenna subsystem that is automatically configurable to one of an on-body configuration and a free space configuration, according to one or more embodiments.

According to aspects of the present innovation, a communication device, a method, and a computer program product provide an antenna subsystem that is automatically configurable to one of an on-body configuration and a free space configuration based on sensing whether on-body or not. The antenna subsystem includes an elongate antenna element having a first and a second end separated by an aperture. A transceiver is electrically grounded to a ground plane and communicatively coupled via an antenna feed to the elongate antenna element. A first conductor is electrically attached to a first edge of the ground plane. An aperture switch is positioned at the aperture and mechanically coupled to the first and second ends of the elongate antenna element and to the first conductor. The aperture switch is electrically configurable in an open position that electrically isolates (a) the first end of the elongate antenna element; (b) the second end of the elongate antenna element; and (c) the first conductor. The aperture switch is electrically configurable in a closed position that electrically couples: (a) the first end of the elongate antenna element; (b) the second end of the elongate antenna element; and (c) the first conductor. An antenna switching controller is communicatively coupled to the aperture switch. The antenna switching controller selectively actuates the aperture switch to be in one of the open and closed positions, based on whether the communication device is positioned on a body.

Rather than being limited to just one of on-body mode or free space mode, certain communication devices would be useful in being able to operate effectively in either on-body mode or FS mode. For example, musical interface digital interface (MIDI) devices are used to connect devices that make and control sound, such as synthesizers, samplers, and computers. MIDI devices enable other devices to communicate with each other, using MIDI messages. MIDI devices can use wireless connections, such as BLUETOOTH or WI-FI, to link to one or both interfaced devices. With many possible scenarios of use, communication devices that utilize wireless MIDI devices require an ability to wirelessly communicate in either on-body mode or FS mode. In addition, devices such as smart phones would benefit from being able to be used in FS mode and on body mode. Similarly, devices such as smart speakers would benefit from being able to be used on body and in FS mode.

In the following detailed description of exemplary embodiments of the disclosure, specific exemplary embodiments in which the various aspects of the disclosure may be practiced are described in sufficient detail to enable those skilled in the art to practice the invention, and it is to be understood that other embodiments may be utilized and that logical, architectural, programmatic, mechanical, electrical and other changes may be made without departing from the spirit or scope of the present disclosure. The following detailed description is, therefore, not to be taken in a limiting sense, and the scope of the present disclosure is defined by the appended claims and equivalents thereof. Within the descriptions of the different views of the figures, similar elements are provided similar names and reference numerals as those of the previous figure(s). The specific numerals assigned to the elements are provided solely to aid in the description and are not meant to imply any limitations (structural or functional or otherwise) on the described embodiment. It will be appreciated that for simplicity and clarity of illustration, elements illustrated in the figures have not necessarily been drawn to scale. For example, the dimensions of some of the elements are exaggerated relative to other elements.

It is understood that the use of specific component, device and/or parameter names, such as those of the executing utility, logic, and/or firmware described herein, are for example only and not meant to imply any limitations on the described embodiments. The embodiments may thus be described with different nomenclature and/or terminology utilized to describe the components, devices, parameters, methods and/or functions herein, without limitation. References to any specific protocol or proprietary name in describing one or more elements, features or concepts of the embodiments are provided solely as examples of one implementation, and such references do not limit the extension of the claimed embodiments to embodiments in which different element, feature, protocol, or concept names are utilized. Thus, each term utilized herein is to be given its broadest interpretation given the context in which that term is utilized.

As further described below, implementation of the functional features of the disclosure described herein is provided within processing devices and/or structures and can involve use of a combination of hardware, firmware, as well as several software-level constructs (e.g., program code and/or program instructions and/or pseudo-code) that execute to provide a specific utility for the device or a specific functional logic. The presented figures illustrate both hardware components and software and/or logic components.

Those of ordinary skill in the art will appreciate that the hardware components and basic configurations depicted in the figures may vary. The illustrative components are not intended to be exhaustive, but rather are representative to highlight essential components that are utilized to implement aspects of the described embodiments. For example, other devices/components may be used in addition to or in place of the hardware and/or firmware depicted. The depicted example is not meant to imply architectural or other limitations with respect to the presently described embodiments and/or the general invention.

The description of the illustrative embodiments can be read in conjunction with the accompanying figures. Embodiments incorporating teachings of the present disclosure are shown and described with respect to the figures presented herein.

FIG. 1 is a simplified functional block diagram illustrating example communication device 100 that includes an antenna subsystem 102 that is automatically configurable to one of an on-body configuration or operating mode and a free space configuration or operating mode. As used herein, reference numeral "102" refers generally to antenna subsystem 102 that can automatically switch between the two types of antennas. Specific examples are introduced with an alphabetical suffix. Specific examples of antenna subsystem 102 include antenna subsystem 102*a* (FIGS. 2A-2B), which forms planar inverted F antenna (PIFA) and dual inverted "L" antenna (DILA), respectively. Specific examples of antenna subsystem 102 include antenna subsystem 102*b* (FIG. 3A-3B), which forms PIFA and folded monopole antenna respectively. Communication device 100 can be one of a host of different types of devices, including but not limited to, a mobile cellular phone, satellite phone, or smart-phone, a laptop, a net-book, an ultra-book, a networked smart watch or networked sports/exercise watch, and/or a tablet computing device or similar device that can include wireless communication functionality. As a device supporting wireless communication, communication device 100 can be utilized as, and also be referred to as, a system, device, subscriber unit, subscriber station, mobile station (MS), mobile, mobile device, remote station, remote terminal, user terminal, terminal, user agent, user device, a Session Initiation Protocol (SIP) phone, a wireless local loop (WLL) station, a personal digital assistant (PDA), a handheld device having wireless connection capability, a computing device, or other processing devices connected to a wireless modem. These various devices all provide and/or include the necessary hardware and software to support the various wireless or wired communication functions as part of a communication system. Communication device 100 can also be an over-the-air link in a communication system. Communication device 100 can be intended to be portable, hand-held, wearable, detachable, or positioned in a fixed location. Examples of such over-the-air link communication devices (100) include a wireless modem, an access point, a repeater, a wirelessly-enabled kiosk or appliance, a femtocell, a small coverage area node, and a wireless sensor, etc.

Referring now to the specific component makeup and the associated functionality of the presented components, communication device 100 includes over-the-air (OTA) communication subsystem 103 that communicates with external OTA communication system 104. Communication device 100 provides computing and data storage functionality in support of OTA communication with external OTA communication system 104, as well as other functions, with controller 106, data storage subsystem 107, and input/output (I/O) subsystem 108 that are communicatively coupled to each other via a system interlink 109.

OTA communication subsystem 103 includes communication module 110 that operates in baseband to encode data for transmission and decodes received data, according to a predetermined communication protocol. OTA communication subsystem 103 includes radio frequency (RF) front end 111 having one or more modem(s) 112. Modem(s) 112 modulate baseband encoded data from communication module 110 onto a carrier signal to provide a transmit signal that is amplified by transmitter(s) 113. Modem(s) 112 demodulates the received signal from antenna subsystem, node 122, and 102. The received signal is amplified and filtered by receiver(s) 115, demodulating received encoded data from a received carrier signal. Antenna configuration controller 116 electrically configures antenna subsystem 102 using antenna tuning circuitry 117 to adjust antenna impedance of antenna subsystem 102. Antenna tuning circuitry 117 improves antenna efficiency at desired transmit or receive frequencies of transmitter(s) 113 and receiver(s) 115, respectively, within transceiver(s) 118. In one or more embodiments, communication device 100 is proximate to, or on, a body generating a lossy dielectric effect for communication device 100. Antenna tuning circuitry 117 is electrically coupled to elongate antenna element 160 to compensate for a lossy dielectric effect. RF front end 111 includes transmit power control 119 to adjust uplink transmit power, as required, to effectively communicate with external OTA communication system 104 and to remain within regulated limits.

Controller 106 controls the communication subsystem 103, user interface device 149, and other functions and/or operations of communication device 100. These functions and/or operations include, but are not limited to including, application data processing and signal processing. Communication device 100 may use hardware component equivalents for application data processing and signal processing. For example, communication device 100 may use special purpose hardware, dedicated processors, general purpose computers, microprocessor-based computers, micro-controllers, optical computers, analog computers, dedicated processors and/or dedicated hard wired logic. As utilized herein, the term "communicatively coupled" means that information signals are transmissible through various interconnections, including wired and/or wireless links, between the components. The interconnections between the components can be direct interconnections that include conductive transmission media or may be indirect interconnections that include one or more intermediate electrical components. Although certain direct interconnections (interlink 109) are illustrated in FIG. 1, it is to be understood that more, fewer, or different interconnections may be present in other embodiments.

In one or more embodiments, controller 106, via OTA communication subsystem 103, performs multiple types of OTA communication with external OTA communication system 104. OTA communication subsystem 103 can communicate with one or more personal access network (PAN) devices within external OTA communication system 104, such as smart watch 120 that is reached via Bluetooth connection. In one or more embodiments, OTA communication subsystem 103 communicates with one or more locally networked devices via a wireless local area network (WLAN) link provided by WLAN node 122. WLAN node 122 is in turn connected to wide area network 128, such as the Internet. In one or more embodiments, OTA communication subsystem 103 communicates with global positioning system (GPS) satellites 127 to obtain geospatial location information. In one or more embodiments, OTA communication subsystem 103 communicates with radio access network (RAN) 129 having respective base stations (BSs) or cells 130. RANs 129 are a part of a wireless wide area network (WWAN) that is connected to wide area network 128 and provides data and voice services.

Controller 106 includes processor subsystem 132, which executes program code to provide functionality of the communication device 100. Processor subsystem 132 includes one or more central processing units (CPUs) ("data processor") 133. In one or more embodiments, processing subsystem 132 includes a digital signal processor (DSP) 134. Controller 106 includes system memory 135, which contains actively used program code and data. In one or more embodiments, system memory 135 includes therein a plurality of such program code and modules, including applications such as antenna configuration application 136 and other applications 138. System memory 135 can also include operating system (OS) 139, firmware interface 140 such as basic input/output system (BIOS) or Uniform Extensible Firmware Interface (UEFI), and platform firmware 141. These software and/or firmware modules have varying functionality when their corresponding program code is executed by processor subsystem 132 or secondary processing devices within communication device 100.

Data storage subsystem 107 provides nonvolatile storage accessible to controller 106. For example, data storage subsystem 107 can provide a large selection of other applications 138 that can be loaded into system memory 135. In one or more embodiments, local data storage device(s) 144 includes hard disk drives (HDDs), optical disk drives, solid state drives (SSDs), etc. In one or more embodiments, removable storage device (RSD) 145 that is received in RSD interface 146 is a computer program product or computer readable storage device, which can be referred to as non-transitory. RSD 145 can be accessed by controller 106 to provision communication device 100 with program code. When executed by controller 106, the program code provides the functionality to communication device 100 to perform aspects of the present innovation described herein.

I/O subsystem 108 includes input and output devices. For example, image capturing device 148, such as a camera, can receive gestures and other image data. User interface device 149 presents visual or tactile outputs as well as receive user inputs. Tactile/haptic control 150 provides an interface such as for braille reading or manual inputs. Microphone 151 receives user audible inputs. Audio speaker 152 provides audio output, including audio playback and alerts. Range finder 153 emits a waveform of energy, such as acoustic, infrared, radio frequency (RF), etc., whose time of flight is used to measure distance to a reflecting object. I/O subsystem 108 can be wholly or substantially encompassed by device housing 154. In one or more embodiments, I/O controller 155 connects to one or more peripheral devices 156 that can include additional I/O functionality. I/O controller 155 can also interface to a wired local access network (LAN) (not shown). In one or more embodiments, I/O subsystem 108 is used to detect whether communication device 100 is on, or proximate to, a person.

In one or more embodiments, antenna subsystem 102 enables long-range communication in ultra-low band (ULB) and low band (LB) in a small housing 154 in both on-body and free-space (FS) modes. Antenna subsystem 102 includes a top conductor that is an elongate antenna element 160 having first and second ends 162*a*, 162*b* separated by aperture 164. Antenna subsystem 102 includes a bottom conductor that is ground plane 166. Antenna subsystem 102 includes first conductor 168 that is electrically attached to a first edge 170*a* of ground plane 166 and extends to a location proximate to aperture 164. Transceiver 118 is electrically grounded to ground plane 166 and communicatively coupled via antenna feed 172 to elongate antenna element 160. Antenna subsystem 102 includes aperture switch 174 positioned at aperture 164. Aperture switch 174 is mechanically coupled to first and second ends 162*a*, 162*b* of elongate antenna element 160. Aperture switch 174 is mechanically coupled to first conductor 168 at aperture 164. Aperture switch 174 is electrically configurable in one of (i) an open position and (ii) a closed position. In one or more embodiments, the open position is an unactuated ("off") state and the closed position is an actuated ("on") state. For clarity, the term actuate is used herein to refer to enabling aperture switch 174 to change state between open and closed or between closed and open.

Communication device 100 has on-body sensor 176 that detects whether communication device 100 is on or proximate to a body, such as a human body. As used herein, on-body sensors 176 can be integral, attachable, peripheral, or networked to communication device 100. Specific examples of on-body sensor 176, such as capacitance sensor 176*a* and proximity sensor 176*b*, are introduced with an alphabetical suffix. In one or more embodiments, on-body sensor 176 can be implemented as a capacitance sensor 176*a* electrically coupled across first and second ends 162*a*, 162*b* of elongate antenna element 160. Proximity of a body to elongate antenna element 160 can be sensed by a change in impedance of elongate antenna element 160. In one or more embodiments, on-body sensor 176 can be implemented as a physical proximity sensor. Examples of physical proximity sensors include lidar, radar, range finding, top hat buttons or mechanical contact switches presented on housing 154.

Antenna switching controller 178 is communicatively coupled to on-body sensor 176 and aperture switch 174. Antenna switching controller 178 selectively actuates aperture switch 174 to be in one of the open and closed positions based on whether communication device 100 is positioned on a body or not, as indicated by on-body sensor 176. In one or more embodiments, antenna switching controller 178 enables communication device 100 to: (i) determine, based on on-body sensor 176, whether communication device 100 is positioned on a body; (ii) in response to determining that communication device 100 is on a body, actuate aperture switch 174 to be in the closed position for on-body operational mode; and (iii) in response to determining that communication device 100 is not on a body, actuate aperture switch to be in the open position for free space operational mode.

In one or more embodiments, antenna switching controller 178 includes components wholly within antenna subsystem 102 that respond directly to on-body sensor 176. In one or more embodiments, antenna switching controller 178 includes components of RF front end 111 that detect impedance changes in antenna subsystem 102. In one or more embodiments, antenna switching controller 178 includes controller 106 that determines when to actuate antenna switch 174. For example, one or both position modes of antenna switch 174 could require current drain. Antenna configuration application 136 of controller 106 could enable antenna switching controller 178 to be in an active state when communication is planned. Antenna configuration application 136 of controller 106 could infer on-body or free space state based on different types of on-body sensors 176. For example, active use of cellular communication with audio set to earpiece and not in loudspeaker mode could be detected. In this mode, proximity of the ear of a user to the communication device 100 can be inferred. As another example, front side camera could recognize proximity to a body.

In one or more embodiments, when aperture switch 174 is in the open position, aperture switch 174 electrically uncouples from each of the first and second ends 162*a*, 162*b* of elongate antenna element 160 and first conductor 168 from each other, providing a dual inverted "L" antenna (DILA). When aperture switch 174 is in the closed position, aperture switch 174 electrically couples to each of the first and second ends 162*a*, 162*b* of elongate antenna element 160 and first conductor 168, providing a hollow planar inverted "F" antenna (PIFA).

In one or more embodiments, second conductor 180 is communicatively coupled to first end 162*a* of elongate antenna element 160 and second edge 170*b* of ground plane 166, substantially opposite to first edge 170*a*. Third conductor 182 is communicatively coupled to second end 162*b* of elongate antenna element 160 and third edge 170*c* of ground plane 166, substantially opposite to first edge 170*a* and spaced apart from second edge 170*b*. In the open position, aperture switch 174 configures an interconnection of first and second ends 162*a*, 162*b* of elongate antenna element 160, first conductor 168, second conductor 180, and third conductor 182. Each conductor 168, 180, 182 is also connected to ground plane 166. The interconnection provides a folded monopole antenna. In particular, when antenna switching controller 178 actuates aperture switch 174 to the open position, aperture switch 174 electrically uncouples each of the first and second ends 162*a*, 162*b* of elongate antenna element 160 and first conductor 168 from each other. Second and third conductors 180, 182 remain electrically coupled, respectively, to first and second ends 162*a*, 162*b* of elongate antenna element 160. When aperture switch 174 is in the closed position, aperture switch 174 is electrically coupled to each of the first and second ends 162*a*, 162*b* of elongate antenna element 160 and 168 and to ground plane 166. In the closed position, aperture switch 174 provides a hollow PIFA for on-body mode.

Figure 2A:
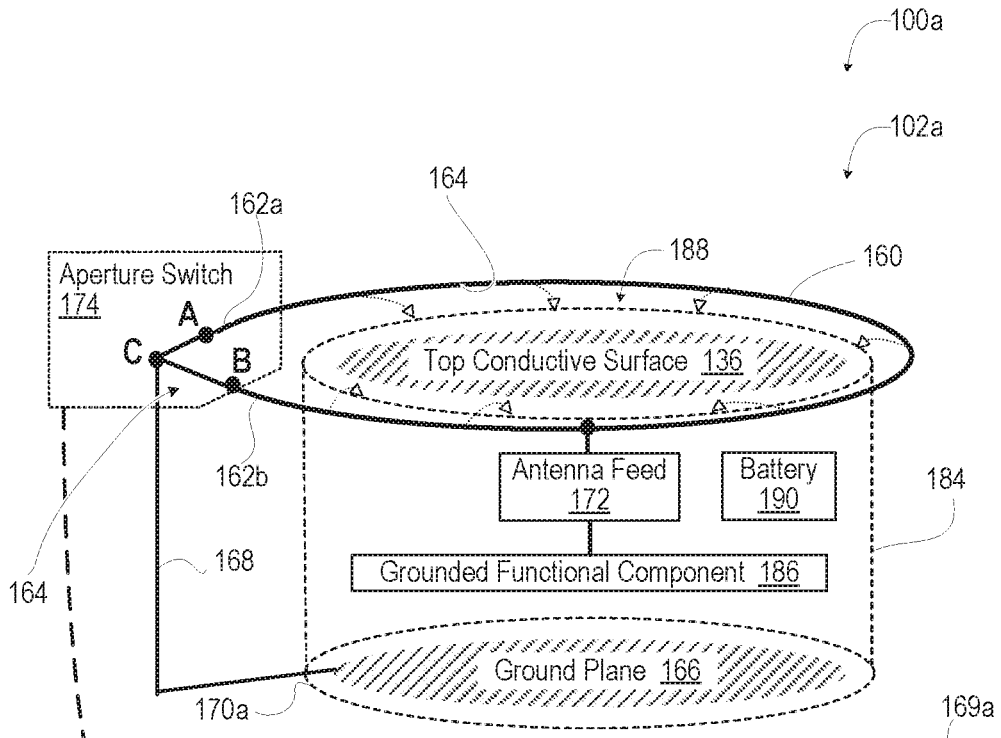
FIG. 2A is a simplified diagram illustrating an example communication device having the antenna subsystem configured as a planar inverted F antenna (PIFA) for on-body mode, according to one or more embodiments.
Figure 2B:
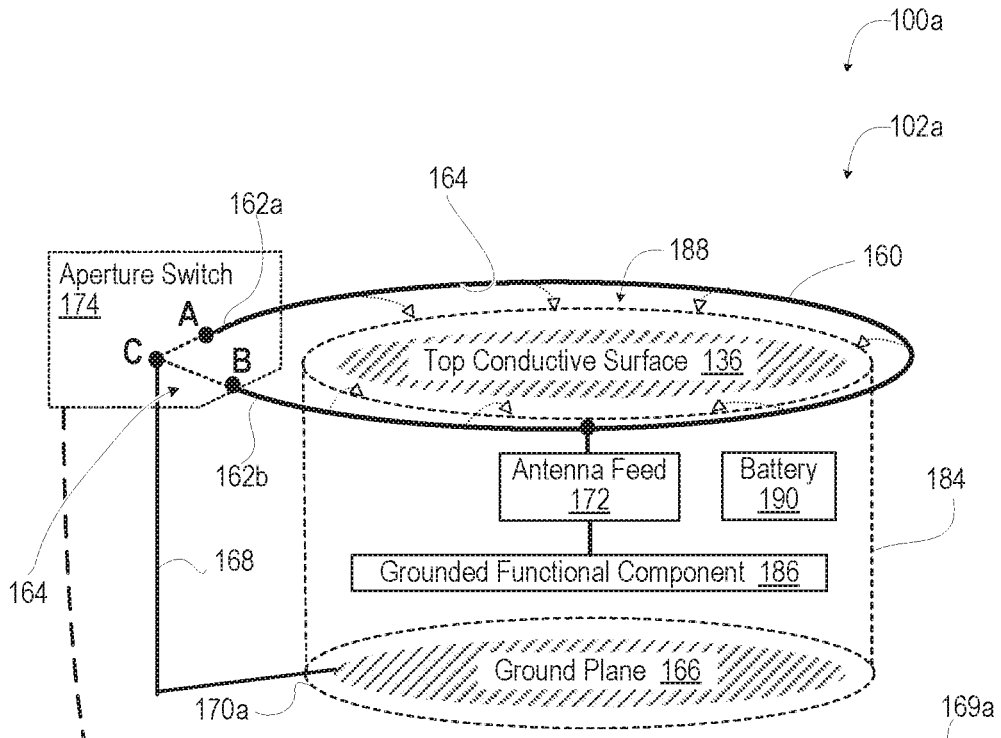
FIG. 2B is a simplified diagram illustrating the example communication device of FIG. 2A having the antenna subsystem configured as a dual inverted "L" antenna (DILA) for free-space mode, according to one or more embodiments.

FIGS. 2A-2B illustrate example antenna subsystem 102*a*, which is configurable via aperture switch 174 by antenna switching controller 178 in a selected one of: (i) a PIFA for on-body mode (FIG. 2A); and (ii) a DILA for free-space mode (FIG. 2B). In one or more embodiments, as shown in FIG. 2A, the ON state of the closed position electrically couples together: (a) first end 162*a* of elongate antenna element 160; (b) second end 162*b* of elongate antenna element 160; and (c) first conductor 168. Inversely, in FIG. 2B, the OFF state of the open position electrically isolates (a) first end 162*a* of elongate antenna element 160; (b) second end 162*b* of elongate antenna element 160; and (c) first conductor 168 from each other. This operation is summarized in Table 169*a*.

According to aspects of the present disclosure, in one or more embodiments, other switch arrangements are used that yield the same two desired antenna structures with a different arrangement of open or closed switch throws. For example, if one of the switches is displaced from a first location on antenna subsystem 102*a* via a one-quarter-wavelength transmission line, the displacement of the switch would invert the logic for that switch. The switch, when closed, would present as an open path to the antenna subsystem 102*a*.

Communication device 100*a* includes an assembly of grounded functional components 186 contained within conductive chassis 184 attached between ground plane 166 and elongate antenna element 160. Grounded functional components 186 includes OTA communication subsystem 103, controller 106, data storage subsystem 107, and I/O subsystem 108 as shown in FIG. 1. The present innovation enables antenna subsystem 102*a* to be an electrically-small antenna that fits within a small form-factor dictated by dimensions of communication device 100*a*. Antenna subsystem 102*a* is reconfigurable for different use-cases, including on-body (wearable) and free-space (table-top). In one or more embodiments, grounded functional components 186 physically includes printed circuit board (PCB) ground, PCB shields, conductive pad, and battery chassis, which are all RF-shorted to one another and to ground plane 166. Conductive chassis 184 is wrapped around a battery 190. Conductive chassis 184 has a top conductive surface 136 that is electrically grounded to ground plane 166 and extends proximate to elongate antenna element 160. Grounded functional components 186 within conductive chassis 184 provide an antenna system ground that is made of copper in one or more embodiments. In one or more embodiments, elongate antenna element 160 has a hollow elongate antenna aperture 164 with a round annular shape. Electromagnetic field 188 extends between an inner edge of elongate antenna element 160 and top conductive surface 136.

Figure 3A:
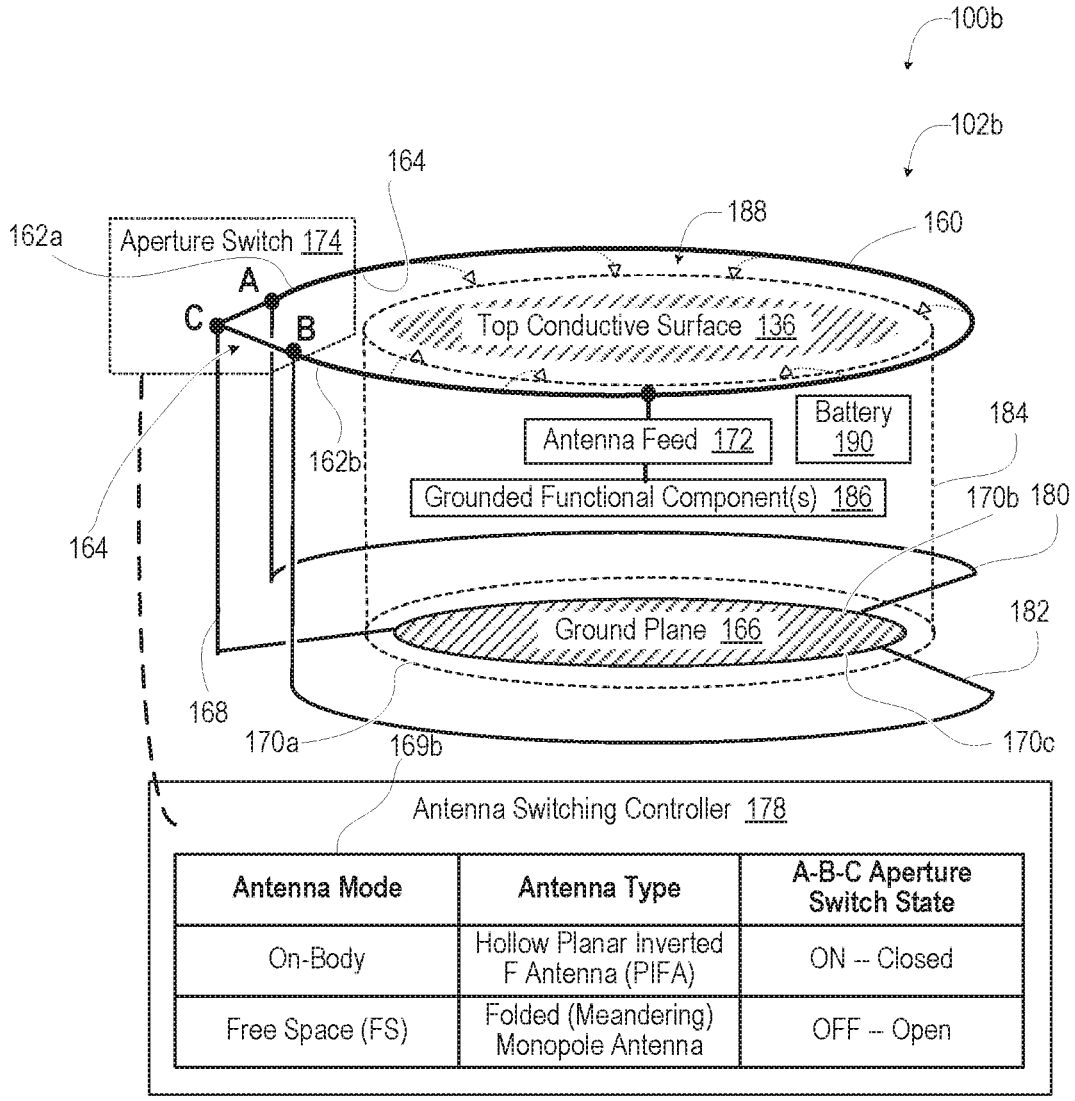
FIG. 3A is a simplified diagram illustrating an example communication device having the antenna subsystem configured as a PIFA for on-body mode, according to one or more embodiments.
Figure 3B:
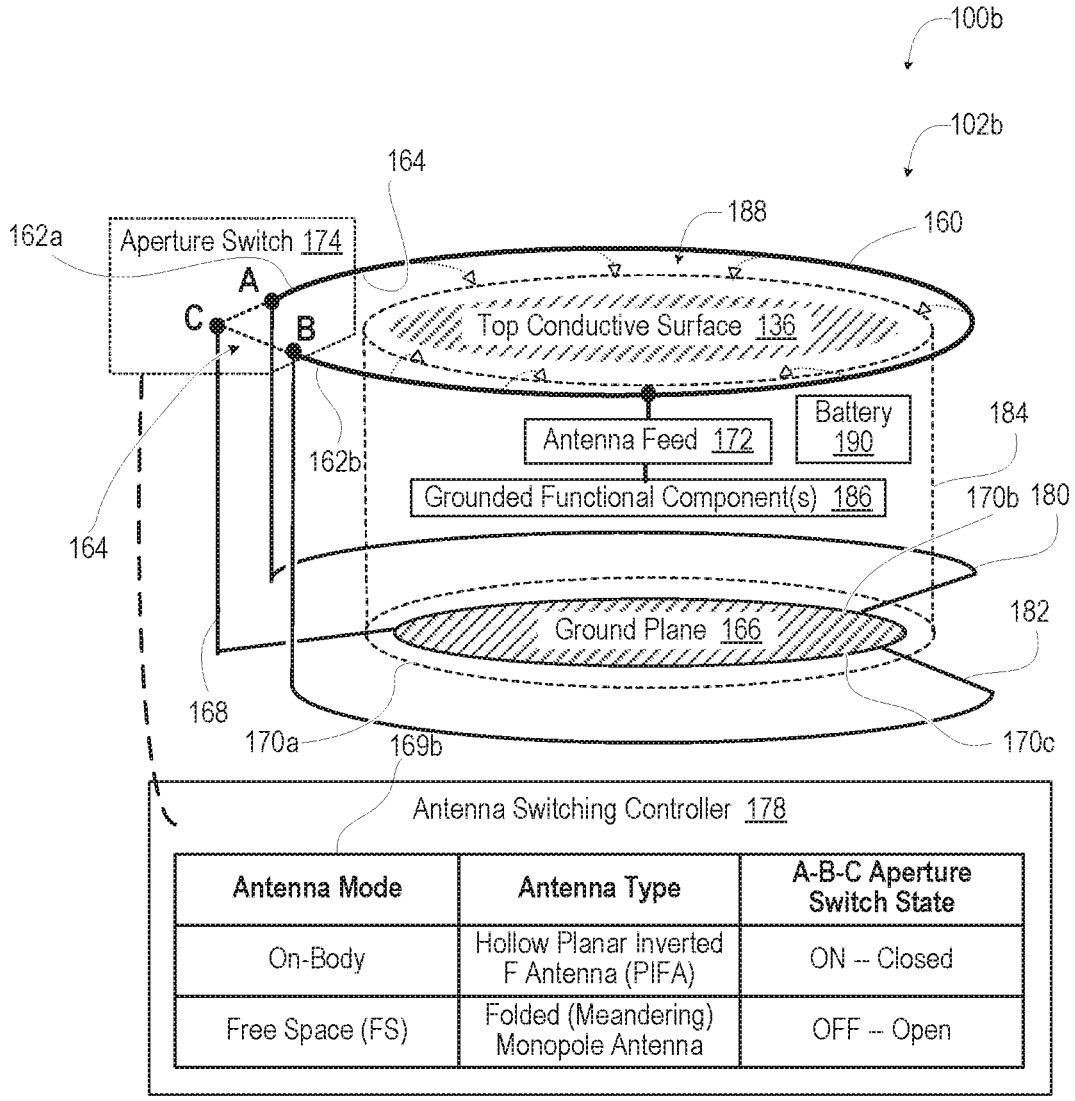
FIG. 3B is a simplified diagram illustrating the example communication device of FIG. 3A having the antenna subsystem configurable as a folded monopole antenna for free-space mode, according to one or more embodiments.

FIGS. 3A-3B are simplified diagrams of example antenna subsystem 102*b* configurable via aperture switch 174 by antenna switching controller 178 in a selected one of: (i) a PIFA for on-body mode (FIG. 3A); and (ii) a folded monopole antenna for free-space mode (FIG. 3B). The description of example antenna subsystem 102*b* is somewhat similar to that of example antenna subsystem 102*a* (FIG. 2) except that example antenna subsystem 102*b* has additional second and third conductors 180, 182. Second conductor 180 is communicatively coupled to first end 162*a* of elongate antenna element 160 and second edge 170*b* of ground plane 166, substantially opposite to first edge 170*a*. Third conductor 182 is communicatively coupled to second end 162*b* of elongate antenna element 160 and third edge 170*c* of ground plane 166, substantially opposite to first edge 170*a* and spaced apart from second edge 170*b*. For a smoothed edge ground plane 166, such as having a circular shape, first, second and third edges 170*a*, 170*b*, 170*c* refer to distinct tangential edges or portions of the circumference in a particular radial direction.

In the open position shown in FIG. 3B, aperture switch 174 configures an interconnection of first and second ends 162*a*, 162*b* of elongate antenna element 160, first conductor 168, second conductor 180, and third conductor 182 into a folded monopole antenna. In particular, when aperture switch 174 is in the open position, aperture switch 174 electrically uncouples each of first and second ends 162*a*, 162*b* of elongate antenna element 160 and first conductor 168 from each other. Second and third conductors 180, 182 remain electrically coupled respectively to first and second ends 162*a*, 162*b* of elongate antenna element 160. When aperture switch 174 is in the closed position in FIG. 3A, aperture switch 174 electrically couples together the first and second ends 162*a*, 162*b* of elongate antenna element 160 and first conductor 168, providing a hollow planar inverted "F" antenna (PIFA). First conductor 168 has low electrical impedance as compared to both second and third conductors 180, 182. When in the closed position in FIG. 3A, first conductor 168 renders contribution of second and third conductors 180, 182 to antenna performance to be negligible, so that antenna subsystem 102*b* provides PIFA similar to antenna subsystem 102*a* (FIG. 2A). This operation is summarized in Table 169*b* provided in FIG. 3A.

In one or more embodiments, elongate antenna element 160 is circular except for aperture 164. Antenna element 160 makes contact to first, second, and third conductors 168, 180, 182 that provide three bottom conductor legs. The vertical height of the three bottom conductor legs encompasses the vertical height of the grounded chassis 184. Second and third conductors 180, 182 are almost semicircles that are shorted to ground plane 166, which provides a battery ground at the bottom of communication device 100*b*. First conductor 168 is a third leg formed from a straight piece of copper making contact to ground plane 166.

Figure 4:
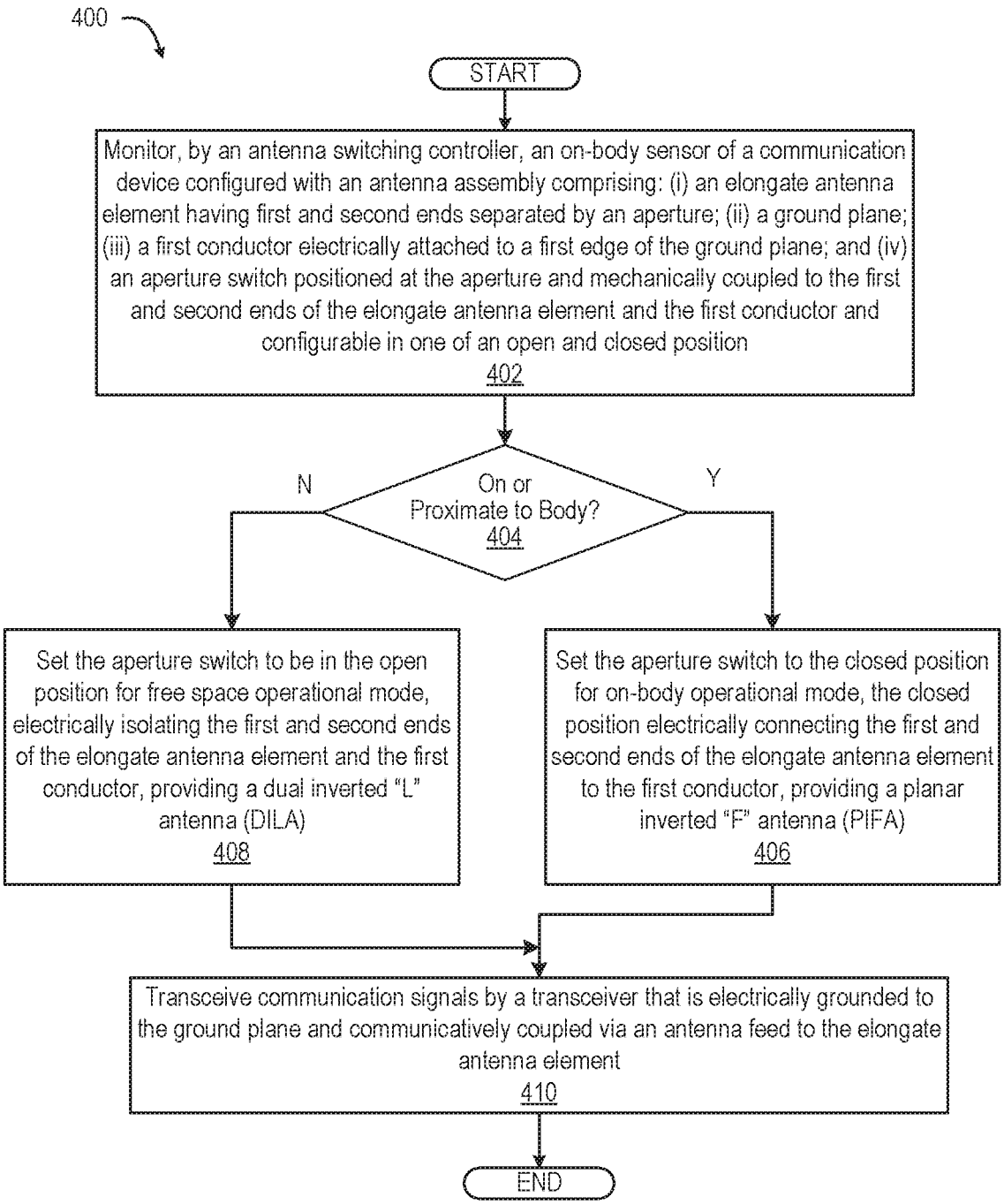
FIG. 4 is a flow diagram illustrating a method for automatically configuring an antenna subsystem of a communication device for on-body mode operation and as a as DILA for free-space mode operation, according to one or more embodiments.

FIG. 4 illustrates example method 400 for automatically configuring an antenna subsystem 102*a* of communication device 100 (FIG. 2) for on-body and free-space modes. Method 400 includes monitoring, by an antenna switching controller, an on-body sensor of a communication device configured with an antenna assembly. The on-body sensor can be a capacitance sensor, proximity sensor, etc. The on-body position affects antenna performance of the elongated antenna element and can place output transmit power limitations on communication device 100 (FIG. 1). The antenna assembly includes: (i) an elongate antenna element having first and second ends separated by an aperture; (ii) a ground plane; (iii) a first conductor electrically attached to a first edge of the ground plane; and (iv) an aperture switch positioned at the aperture and mechanically coupled to the first and second ends of the elongate antenna element and the first conductor and configurable in one of an open and closed position (block 402). Method 400 includes determining, based on an output from the on-body sensor, whether the communication device is positioned on or proximate to a body (decision block 404). In response to determining that the communication device is on or proximate to a body, method 400 includes setting the aperture switch to the closed position for on-body operational mode. The closed position electrically connects the first and second ends of the elongate antenna element to the first conductor, providing a planar inverted "F" antenna (PIFA) (block 406). In response to determining, at decision block 404, that the communication device is not on or proximate to a body, method 400 includes setting the aperture switch to be in the open position for free space operational mode, electrically isolating the first and second ends of the elongate antenna element and the first conductor, providing a dual inverted "L" antenna (DILA) (block 408). Subsequent to setting the aperture switch to closed position in block 406 or to open position in block 408, method 400 includes transceiving communication signals by a transceiver. The transceiver is electrically grounded to the ground plane and communicatively coupled via an antenna feed to the elongate antenna element (block 410). Then method 400 ends.

Figure 5:
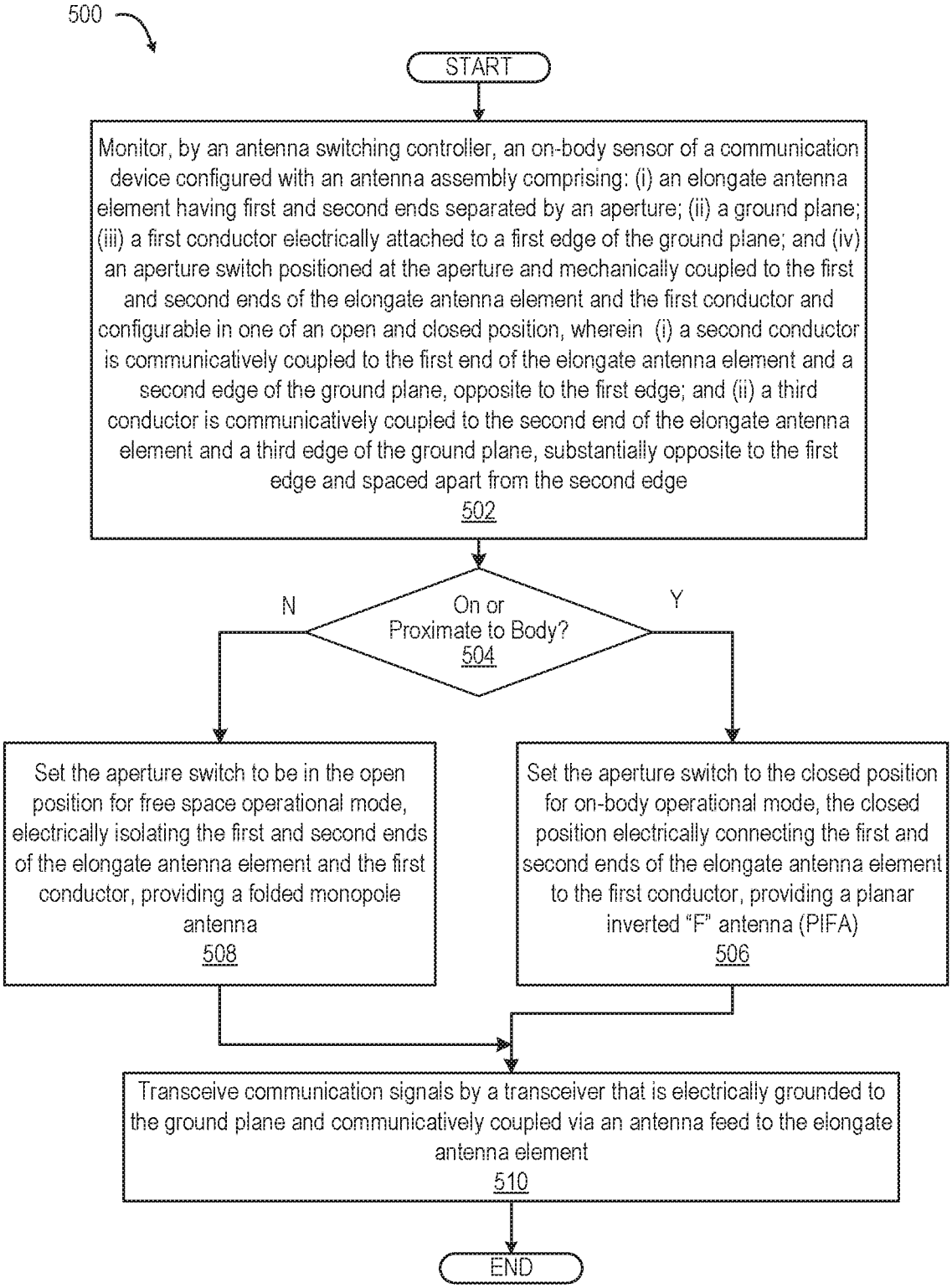
FIG. 5 is a flow diagram illustrating a method for automatically configuring an antenna subsystem of a communication device for on-body mode operation and as a folded monopole antenna for free-space mode operation, according to one or more embodiments.

FIG. 5 illustrates example method 500 for automatically configuring an antenna subsystem 102*b* of communication device 100 (FIG. 2) for on-body and free-space modes. Method 500 includes monitoring, by an antenna switching controller, an on-body sensor of a communication device configured with an antenna assembly. The antenna assembly includes: (i) an elongate antenna element having first and second ends separated by an aperture; (ii) a ground plane; (iii) a first conductor electrically attached to a first edge of the ground plane; and (iv) an aperture switch positioned at the aperture and mechanically coupled to the first and second ends of the elongate antenna element and the first conductor. The aperture switch is configurable in a selected one of: (i) an open; and (ii) a closed position. In addition, a second conductor is communicatively coupled to the first end of the elongate antenna element and a second edge of the ground plane, opposite to the first edge. A third conductor is communicatively coupled to the second end of the elongate antenna element and a third edge of the ground plane, substantially opposite to the first edge and spaced apart from the second edge (block 502). Method 500 includes determining, based on an output from the on-body sensor, whether the communication device is positioned on or proximate to a body (decision block 504). On-body sensor can be a capacitance sensor, proximity sensor, etc. Being on-body effects antenna performance of the elongated antenna element and can place output transmit power limitations on communication device 100 (FIG. 1). In response to determining that the communication device is on or proximate to a body, method 500 includes setting the aperture switch to the closed position for on-body operational mode. The closed position electrically connects the first and second ends of the elongate antenna element to the first conductor, providing a planar inverted "F" antenna (PIFA) (block 506). In response to determining that the communication device is not on or proximate to a body in decision block 504, method 500 includes actuating the aperture switch to be in the open position for free space operational mode. The open position results in electrically isolating the first and second ends of the elongate antenna element and the first conductor, providing a folded monopole antenna (block 508). Subsequent to setting the aperture switch to a closed position in block 506 or to an open position in block 508, method 500 includes transceiving communication signals by a transceiver. The transceiver is electrically grounded to the ground plane and communicatively coupled via an antenna feed to the elongate antenna element (block 510). Then method 500 ends.

In each of the above flow charts presented herein, certain steps of the methods can be combined, performed simultaneously or in a different order, or perhaps omitted, without deviating from the spirit and scope of the described innovation. While the method steps are described and illustrated in a particular sequence, use of a specific sequence of steps is not meant to imply any limitations on the innovation. Changes may be made with regards to the sequence of steps without departing from the spirit or scope of the present innovation. Use of a particular sequence is therefore, not to be taken in a limiting sense, and the scope of the present innovation is defined only by the appended claims.

Aspects of the present innovation are described above with reference to flowchart illustrations and/or block diagrams of methods, apparatus (systems) and computer program products according to embodiments of the innovation. It will be understood that each block of the flowchart illustrations and/or block diagrams, and combinations of blocks in the flowchart illustrations and/or block diagrams, can be implemented by computer program instructions. These computer program instructions may be provided to a processor of a general-purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

As will be appreciated by one skilled in the art, embodiments of the present innovation may be embodied as a system, device, and/or method. Accordingly, embodiments of the present innovation may take the form of an entirely hardware embodiment or an embodiment combining software and hardware embodiments that may all generally be referred to herein as a "circuit," "module" or "system."

While the innovation has been described with reference to exemplary embodiments, it will be understood by those skilled in the art that various changes may be made, and equivalents may be substituted for elements thereof without departing from the scope of the innovation. In addition, many modifications may be made to adapt a particular system, device or component thereof to the teachings of the innovation without departing from the essential scope thereof. Therefore, it is intended that the innovation not be limited to the particular embodiments disclosed for carrying out this innovation, but that the innovation will include all embodiments falling within the scope of the appended claims. Moreover, the use of the terms first, second, etc. do not denote any order or importance, but rather the terms first, second, etc. are used to distinguish one element from another.

The terminology used herein is for the purpose of describing particular embodiments only and is not intended to be limiting of the innovation. As used herein, the singular forms "a", "an" and "the" are intended to include the plural forms as well, unless the context clearly indicates otherwise. It will be further understood that the terms "comprise" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present innovation has been presented for purposes of illustration and description but is not intended to be exhaustive or limited to the innovation in the form disclosed. Many modifications and variations will be apparent to those of ordinary skill in the art without departing from the scope and spirit of the innovation. The embodiments were chosen and described in order to best explain the principles of the innovation and the practical application, and to enable others of ordinary skill in the art to understand the innovation for various embodiments with various modifications as are suited to the particular use contemplated.

What is claimed is:

1. A communication device comprising:

an elongate antenna element having a first and a second end separated by an aperture;

a ground plane;

a transceiver that is electrically grounded to the ground plane and communicatively coupled via an antenna feed to the elongate antenna element;

a first conductor electrically attached to a first edge of the ground plane;

an aperture switch positioned at the aperture and mechanically coupled to the first and second ends of the elongate antenna element and the first conductor, the aperture switch electrically configurable in one of: (i) an open position that electrically isolates (a) the first end of the elongate antenna element; (b) the second end of the elongate antenna element; and (c) the first conductor; and (ii) a closed position that electrically couples: (a) the first end of the elongate antenna element; (b) the second end of the elongate antenna element; and (c) the first conductor; and an antenna switching controller communicatively coupled to the aperture switch, and which selectively actuates the aperture switch to be in one of the open and closed positions based on whether the communication device is positioned on a body.

2. The communication device of claim 1, further comprising an on-body sensor, wherein the antenna switching controller is communicatively coupled to the on-body sensor, and enables the communication device to:

determine, based on the on-body sensor, whether the communication device is positioned on a body;

in response to determining that the communication device is on a body, actuate the aperture switch to be in the closed position for on-body operational mode; and in response to determining that the communication device is not on a body, actuate the aperture switch to be in the open position for free space operational mode.

3. The communication device of claim 1, wherein when the aperture switch is in the open position, an assembly of the aperture switch electrically uncouples each of the first and second ends of the elongate antenna element and the first conductor to ground plane from each other, providing a dual inverted "L" antenna (DILA).

4. The communication device of claim 1, wherein when the aperture switch is in the closed position, an assembly of the aperture switch electrically coupled to each of the first and second ends of the elongate antenna element and the first conductor to the ground plane provides a hollow planar inverted "F" antenna (PIFA).

5. The communication device of claim 3, further comprising:

a second conductor communicatively coupled to the first end of the elongate antenna element and a second edge of the ground plane, substantially opposite to the first edge; and a third conductor communicatively coupled to the second end of the elongate antenna element and a third edge of the ground plane, substantially opposite to the first edge and spaced apart from the second edge.

6. The communication device of claim 5, wherein, in the open position, the aperture switch configures an interconnection of the elongate antenna element, and the first conductor, the second conductor, and the third conductor connected to the ground plane into a folded monopole antenna.

7. The communication device of claim 2, wherein the on-body sensor comprises a capacitance sensor electrically coupled to the elongate antenna element.

8. The communication device of claim 2, wherein the on-body sensor comprises a proximity sensor.

9. The communication device of claim 1, further comprising an assembly of functional components contained within a conductive chassis attached between the ground plane and the elongate antenna element, the chassis comprising a top conductive surface that is electrically grounded to the ground plane and extends proximate to the elongate antenna element.

10. The communication device of claim 1, wherein the elongate antenna element comprises a hollow elongate antenna aperture having an annular shape with the aperture between the first and second ends.

11. The communication device of claim 1, further comprising an antenna tuner electrically coupled to the elongate antenna element and that compensates for a lossy dielectric effect of the device being proximate to or on a body and due to the aperture switch being in the closed position providing a hollow planar inverted "F" antenna (PIFA).

12. A method comprising:

monitoring, by an antenna switching controller, an on-body sensor of a communication device configured with an antenna assembly comprising: (i) an elongate antenna element having first and second ends separated by an aperture; (ii) a ground plane; (iii) a first conductor electrically attached to a first edge of the ground plane; and (iv) an aperture switch positioned at the aperture and mechanically coupled to the first and second ends of the elongate antenna element and the first conductor and configurable in one of an open and closed position;

determining, based on the on-body sensor, whether the communication device is positioned on or proximate to a body, the body effecting antenna performance of the elongated antenna element;

in response to determining that the communication device is on or proximate to a body, setting the aperture switch to the closed position for on-body operational mode, the closed position electrically connecting the first and second ends of the elongate antenna element to the first conductor; and in response to determining that the communication device is not on or proximate to a body, actuating the aperture switch to be in the open position for free space operational mode, electrically isolating the first and second ends of the elongate antenna element and the first conductor.

13. The method of claim 12, further comprising transceiving communication signals by a transceiver that is electrically grounded to the ground plane and communicatively coupled via an antenna feed to the elongate antenna element.

14. The method of claim 12, wherein monitoring the on-body sensor comprises detecting a change in capacitance in an assembly of a capacitance sensor electrically coupled to the elongate antenna element.

15. The method of claim 12, wherein monitoring the on-body sensor comprises monitoring a proximity sensor.

16. The method of claim 12, wherein:

setting the aperture switch to the open position for off-body operational mode comprises electrically uncoupling an assembly of the aperture switch from each of the first and second ends of the elongate antenna element and the first conductor to the ground plane from each other, providing a dual inverted "L" antenna (DILA); and setting the aperture switch to the closed position for being on or proximate to a body comprising electrically coupling an assembly of the aperture switch to each of the first and second ends of the elongate antenna element and the first conductor to the ground plane, providing a planar inverted "F" antenna (PIFA).

17. The method of claim 12, wherein:

setting the aperture switch in the open position for not being on or proximate to a body comprising electrically uncoupling an assembly of the aperture switch from each of the first and second ends of the elongate antenna element and the first conductor to the ground plane from each other, providing a folded monopole antenna, wherein: (i) a second conductor is communicatively coupled to the first end of the elongate antenna element and a second edge of the ground plane, opposite to the first edge; and (ii) a third conductor is communicatively coupled to the second end of the elongate antenna element and a third edge of the ground plane, substantially opposite to the first edge and spaced apart from the second edge; and setting the aperture switch to the closed position for on-body operational mode comprises electrically coupling an assembly of the aperture switch to each of the first and second ends of the elongate antenna element and the first conductor to the ground plane, providing a planar inverted "F" antenna (PIFA).

18. A computer program product comprising:

a computer readable storage device; and program code on the computer readable storage device that when executed by a processor associated with a communication device, the program code enables the communication device to provide the functionality of:

monitoring, by an antenna switching controller, an on-body sensor of the communication device configured with an antenna assembly comprising: (i) an elongate antenna element having first and second ends separated by an aperture; (ii) a ground plane; (iii) a first conductor electrically attached to a first edge of the ground plane; and (iv) an aperture switch positioned at the aperture and mechanically coupled to the first and second ends of the elongate antenna element and the first conductor and configurable in one of an open and closed position;

determining, based on the on-body sensor, whether the communication device is positioned on or proximate to a body, the body effecting antenna performance of the elongated antenna element;

in response to determining that the communication device is on or proximate to a body, setting the aperture switch to the closed position for on-body operational mode, the closed position electrically connecting the first and second ends of the elongate antenna element to the first conductor; and in response to determining that the communication device is not on or proximate to a body, actuating the aperture switch to be in the open position for free space operational mode, electrically isolating the first and second ends of the elongate antenna element and the first conductor.

* * * * *